US006168394B1

(12) United States Patent
Forman et al.

(10) Patent No.: US 6,168,394 B1
(45) Date of Patent: Jan. 2, 2001

(54) AIR DRIVEN DOUBLE DIAPHRAGM PUMP

(75) Inventors: Eric L Forman, Rancho Cucamonga; Greg Dearen, Cherry Valley; Thomas English, Redlands, all of CA (US)

(73) Assignee: Wilden Pump & Engineering Co., Grand Terrace, CA (US)

( * ) Notice: Under 35 U.S.C. 154(b), the term of this patent shall be extended for 0 days.

(21) Appl. No.: 09/336,354

(22) Filed: Jun. 18, 1999

(51) Int. Cl.[7] ..... F04B 17/00
(52) U.S. Cl. ..... 417/395; 417/393
(58) Field of Search ..... 417/395, 393

(56) References Cited

U.S. PATENT DOCUMENTS

| | | | | |
|---|---|---|---|---|
| 4,247,264 | * | 1/1981 | Wilden | 417/393 |
| 4,549,467 | * | 10/1985 | Wilden et al. | 91/307 |
| 4,597,721 | * | 7/1986 | Santefort | 417/393 |
| 4,936,753 | * | 6/1990 | Kozumplik, Jr. et al. | 417/238 |
| 5,074,757 | * | 12/1991 | Horn | 417/63 |
| 5,279,504 | * | 1/1994 | Williams | 417/393 |
| 5,368,452 | * | 11/1994 | Johnson et al. | 417/395 |
| 5,378,122 | * | 1/1995 | Duncan | 417/395 |
| 5,391,060 | * | 2/1995 | Kozumplik, Jr. et al. | 417/393 |
| 5,584,666 | * | 12/1996 | Kozumplik, Jr. et al. | 417/46 |
| 5,711,658 | * | 1/1998 | Conti et al. | 417/393 |
| 5,957,670 | * | 9/1999 | Duncan et al. | 417/395 |

* cited by examiner

*Primary Examiner*—Timothy S. Thorpe
*Assistant Examiner*—Robert Z. Evora
(74) *Attorney, Agent, or Firm*—Lyon & Lyon LLP

(57) ABSTRACT

A double diaphragm pump driven by alternating charges of air includes air chambers and pump chambers to form pump cavities. Diaphragms extend across the pump cavities and are held by their periphery between the mating pump chambers and air chambers. Elbows are coupled with the pump chambers at the inlets and outlets thereof with each of the elbows being identical and including a valve cavity to receive a ball valve. Each ball valve includes a seat with a threaded portion accommodated in either the elbow when the elbow is used at the inlet or the pump chamber at the outlet. The ball valves further include a ball and a ball cage. The components are sized to insure that when the ball is fully unseated, the minimum cross-sectional flow area is at the pump outlet. Sealing surfaces are associated with the valve seat and the associated structure to receive a compressible seal. Annular bolting flanges allow components to be reoriented for particular applications.

23 Claims, 4 Drawing Sheets

AIR DRIVEN DOUBLE DIAPHRAGM PUMP

BACKGROUND OF THE INVENTION

The field of the present invention is air driven diaphragm pumps.

Pumps having double diaphragms driven by compressed air directed through an actuator valve are well known. Reference is made to U.S. Pat. Nos. 5,213,485; 5,169,296; and 4,247,264; and to U.S. Pat. Nos. Des. 294,946; 294,947; and 275,858. Actuator valves using a feedback control system are disclosed in U.S. Pat. Nos. 4,242,941 and 4,549,467. An actuator valve using a timed solenoid is disclosed in U.S. Pat. No. 5,378,122. Current designs for components of such pumping devices are disclosed in U.S. patent applications Ser. Nos. 08/842,377, filed Apr. 23, 1997; 09/116,029, filed Jul. 15, 1998; and 09/115,287, filed Jul. 14, 1998. The disclosures of the foregoing patents and applications are incorporated herein by reference.

Common to the aforementioned patents on air driven diaphragm pumps is the disclosure of two opposed pump cavities. The pump cavities each include a pump chamber, an air chamber and a diaphragm extending fully across the pump cavity defined by these two chamber structures to split the cavity. Each pump chamber includes an inlet and an outlet controlled by check valves. A common shaft typically extends through each air chamber to connect to the diaphragms therein.

A number of different actuator valves are available. Such valves provide alternating air to the air chambers in order that the pump may reciprocate. The actuators may be feedback control systems dependent upon the stroke position or timed independently of the stroke. The mechanisms to determine stroke position and to valve the air also are varied.

Air driven double diaphragm pumps also come in a great range of sizes. The standard indication of pump size is measured by the pump inlet diameter. The materials for such pumps also vary widely from stainless steel to exotic inert polymers. Certain design challenges accompany variations in size and material. With larger pumps, the stocking of parts can become burdensome, tolerances to avoid leakage can become proportionally more critical, overall forces from pumping pressure can be magnified and assembly can prove challenging.

SUMMARY OF THE INVENTION

The present invention is directed to a double diaphragm pump including pump chambers and air chambers mating together, respectively, to form pump cavities. A diaphragm extends across each of the pump cavities. Flow connectors extend to inlets in the pump chambers and also to outlets in the pump chambers. Check valves are associated with both the inlets and the outlets.

In a first separate aspect of the present invention, the flow connectors for both the inlets and the outs of the double diaphragm pump are interchangeable. Each flow connector includes a valve cavity to receive a valve and a threaded valve seat attachment cavity adjacent the valve cavity capable of threadably receiving a valve seat for each valve. The outlets of the pump chambers also each include a threaded valve seat attachment cavity capable of threadably receiving one of the valve seats.

In a second separate aspect of the present invention, the flow connectors of the first separate aspect are further contemplated to variously include outlet ports which have a cross-sectional area at least as small as the flow path through the pump cavities, check valves with the valve elements fully displaced from the valve seats and the flow connectors and mating annular bolting flanges with an equiangularly spaced bolting pattern for versatile attachment to the pump chambers. With the flow connectors formed as elbows, an inlet T-section and an outlet T-section may connect between pairs of connectors. The connectors and the T-sections may have mating annular T-section bolting flanges with an equiangularly spaced T-section bolting pattern.

In a third separate aspect of the present invention, compressible seals positioned between radially extending annular shoulders on threaded valve seats and the radially outward sealing surfaces on both outlet flow connectors and pump chambers adjacent the threaded valve seat attachment cavities provide positive sealing without requiring a sliding fit perpendicular to the plane of the compressible seals with close tolerances.

In a fourth separate aspect of the present invention, valves are arranged in valve cavities at both inlets and outlets to the pump cavities. Each valve includes a valve seat, a ball and a ball cage. The valve seats are threadably engaged with the pump to be held within the valve cavities. The ball cages extend to and angularly interlock with the valve seats. The interlocking allows the ball cages to be used for setting the valve seats.

In a fifth separate aspect of the present invention, flow connectors are coupled with the pump chambers at the inlets and outlets, respectively. The flow connectors and the pump chambers each further include mating annular bolting flanges with an equiangularly spaced bolting pattern. A pump stand associated with the pump includes four legs with each leg having a mounting plate with a plurality of mounting holes matching the equiangular spacing of the bolting pattern. The plates can be positioned and retained between the pump chambers and the flow connectors to support the pump.

In a sixth separate aspect of the present invention, any of the several foregoing separate aspects are contemplated to be combined to provide even greater advantage in pump design.

Accordingly, it is an object of the present invention to provide an improved air driven double diaphragm pump. Other and further objects and advantages will appear hereinafter.

DETAILED DESCRIPTION OF THE PREFERRED EMBODIMENT

Figure 1:
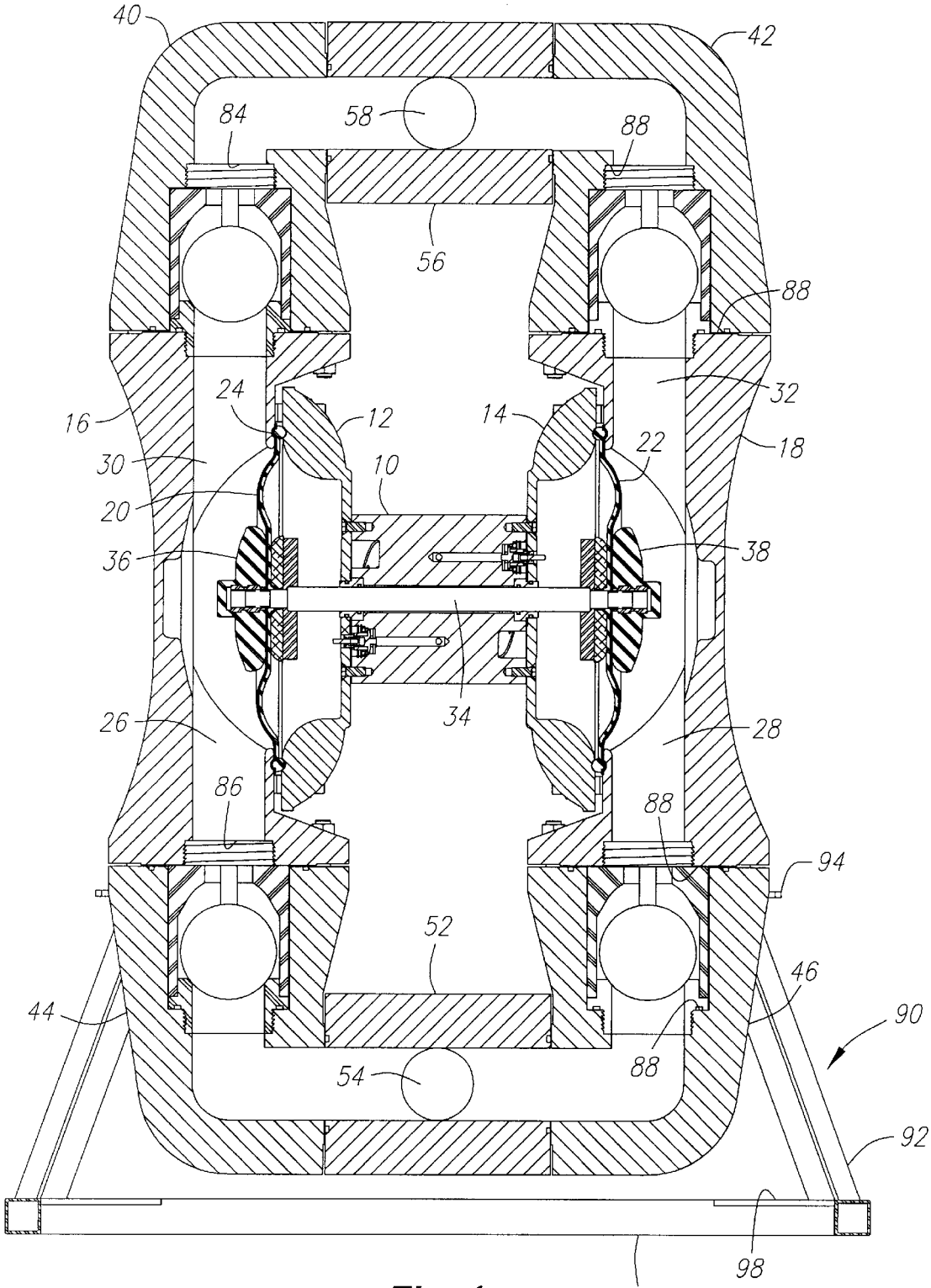
FIG. 1 is a cross-sectional view of an air driven double diaphragm pump.

Turning in detail to the drawings, a double diaphragm pump driven by alternating supplies of compressed air through an actuator 10 is illustrated. The pump includes air chambers 12 and 14 and pump chambers 16 and 18. These chambers form pump cavities. Diaphragms 20 and 22 extend across the pump cavities. A peripheral bead 24 about each of the diaphragms 20 and 22 is retained within matching annular cavities formed in all of the air chambers 12 and 14 and the pump chambers 16 and 18 to seal and hold the peripheries of the diaphragms 20 and 22 in place. The pump chambers 16 and 18 include inlet passages 26 and 28 and outlet passages 30 and 32. A shaft 34 extends through the actuator 10 to assembled pistons 36 and 38 which seal and retain the centers of the diaphragms 20 and 22. The shaft 34 operates in tension to draw one of the pistons and in turn the diaphragm associated therewith into the air chamber. This is accomplished as pressurized air is charged into the opposing air chamber.

Figure 2:
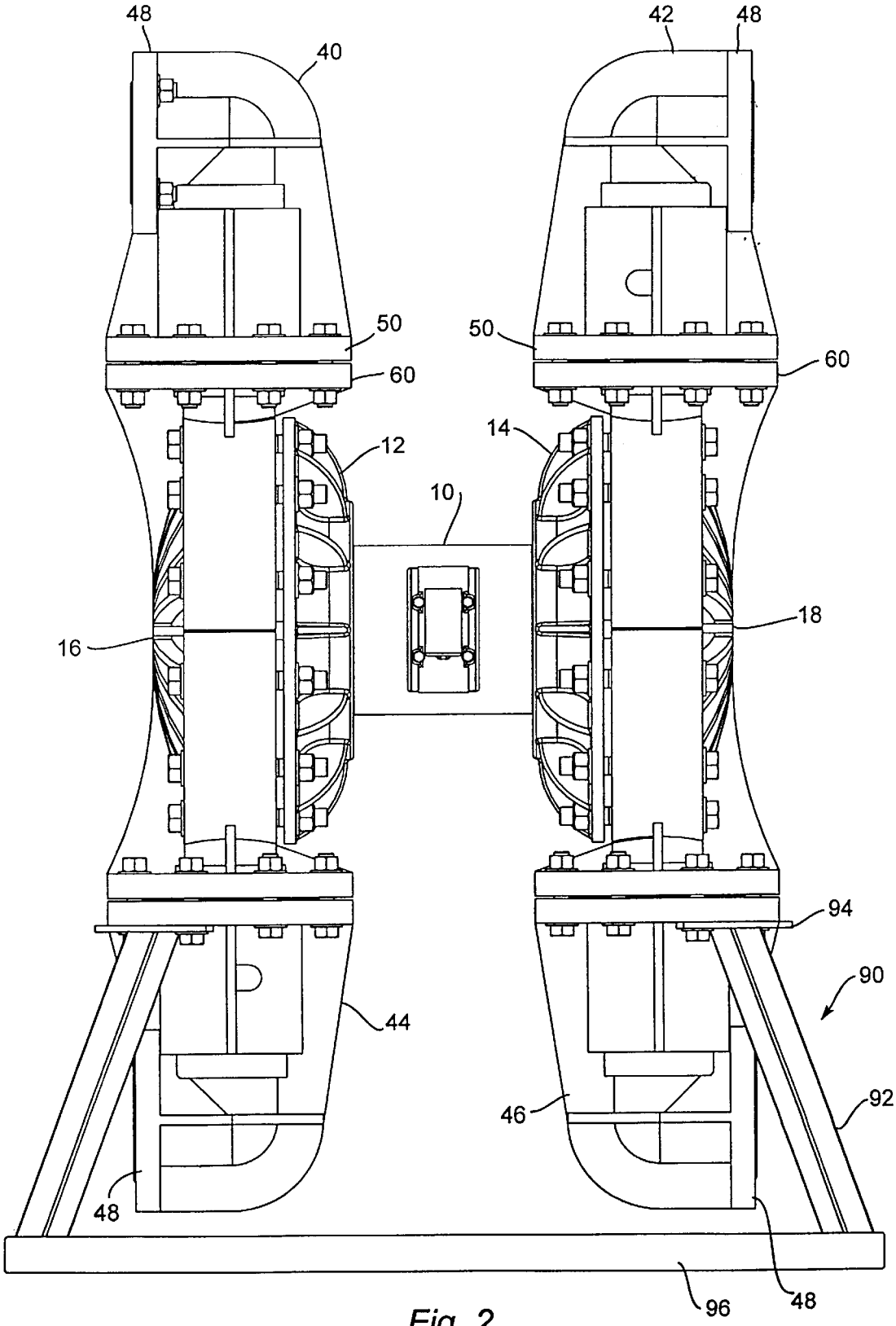
FIG. 2 is a side view of the air driven double diaphragm pump of FIG. 1 assembled in an alternate configuration.
Figure 3:
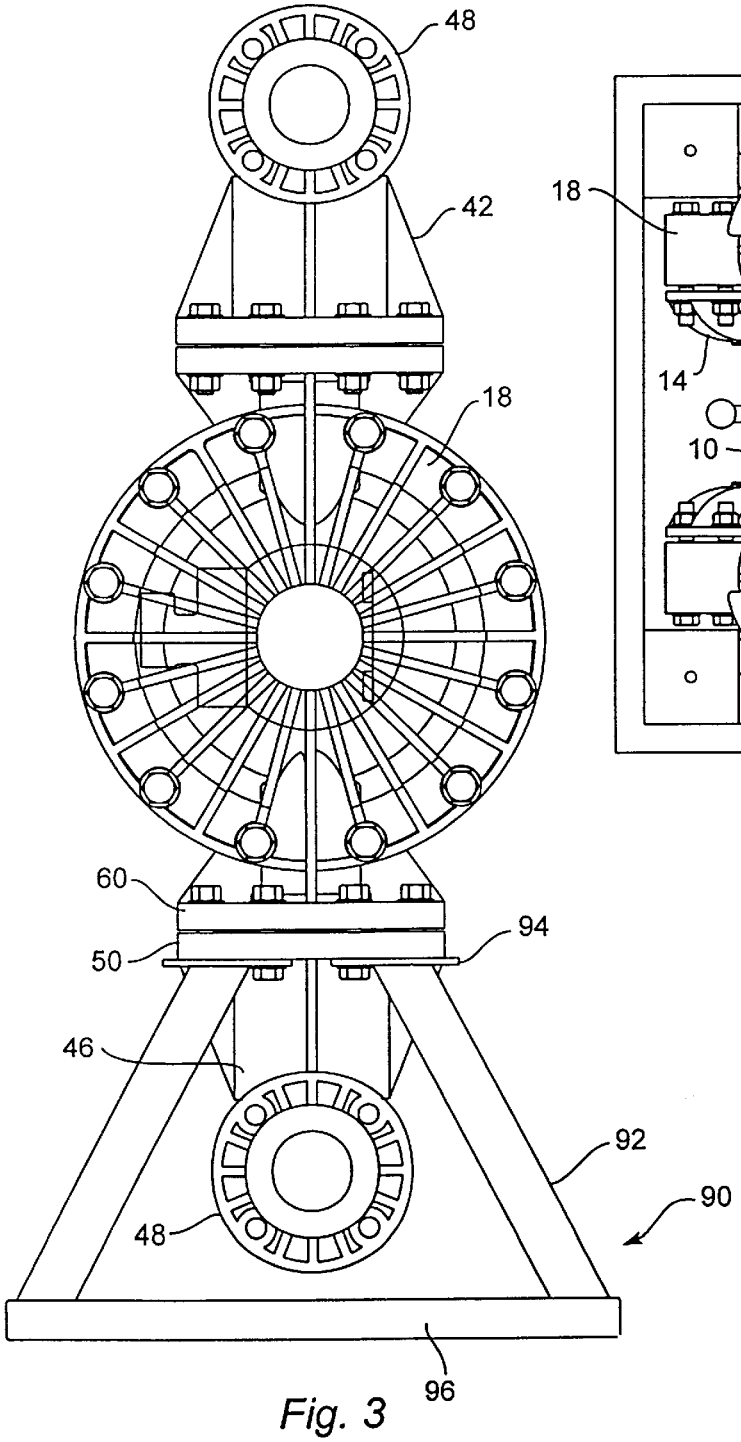
FIG. 3 is an end view of the configuration of the air driven double diaphragm pump of FIG. 2.
Figure 4:
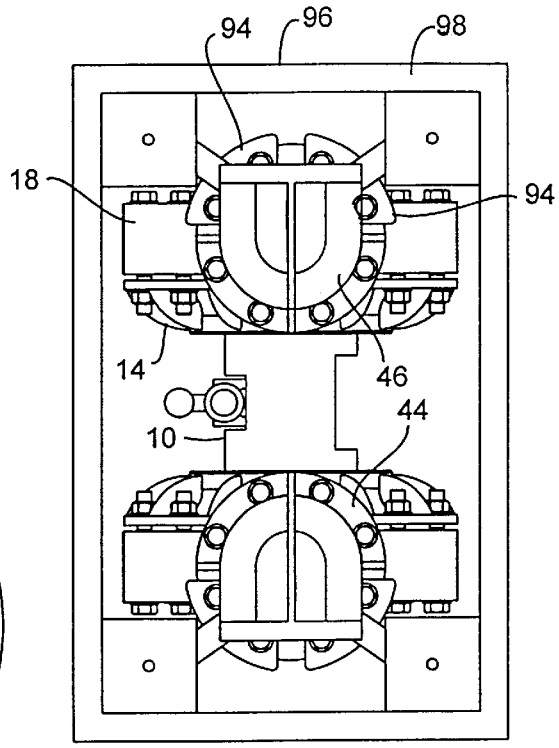
FIG. 4 is a bottom view of the configuration of the air driven double diaphragm pump of FIG. 2.

Four flow connectors 40, 42, 44 and 46 are coupled with the inlets 26 and 28 and the outlets 30 and 32, respectively. The flow connectors 40–46 are shown to be elbows with ANSI standard flanges 48 and 50 at either end. However, the inlet area within each ANSI standard flange is increased to accommodate the valve. Equiangular bolt patterns are arranged about each flange 48 and 50. By employing an equiangular bolt pattern, the flow connectors 40–46 can be fixed in a plurality of positions relative to the pump chambers 16 and 18. FIG. 1 illustrates the flow connectors 40–46 with the passages mutually facing. In FIGS. 2 through 4, the passages face away from one another. In the first case, a common inlet T-section at the bottom of the pump and a common outlet T-section at the top of the pump cause the same stream of fluid to flow through both sides. In FIG. 2, separate fluids may be pumped as there is no common T-section. In FIG. 1, an inlet T-section 52 is bolted to the flow connectors 44 and 46 at the flanges 48. An inlet port 54 also includes a flange for coupling with conventional piping. An outlet T-section 56 with a similar port 58 is bolted to the upper flow connectors 40 and 42 as the flanges of the T-section 52 and 56 also include equiangularly spaced bolting patterns to mate with the flanges 48. The inlet port 54 and outlet port 58 may also be arranged in various directions. Arrangements where one T-section is used at either the inlet or outlet are also possible. O-ring seals may be associated with the ANSI standard flanges to insure appropriate sealing.

The couplings of the flow connectors 40–46 through the flanges 50 to the pump chambers 16 and 18 is accomplished through annular bolting flanges 60. The bolting pattern is equiangularly spaced so that the flow connectors 40–46 may be oriented in a variety of directions.

Figure 5:
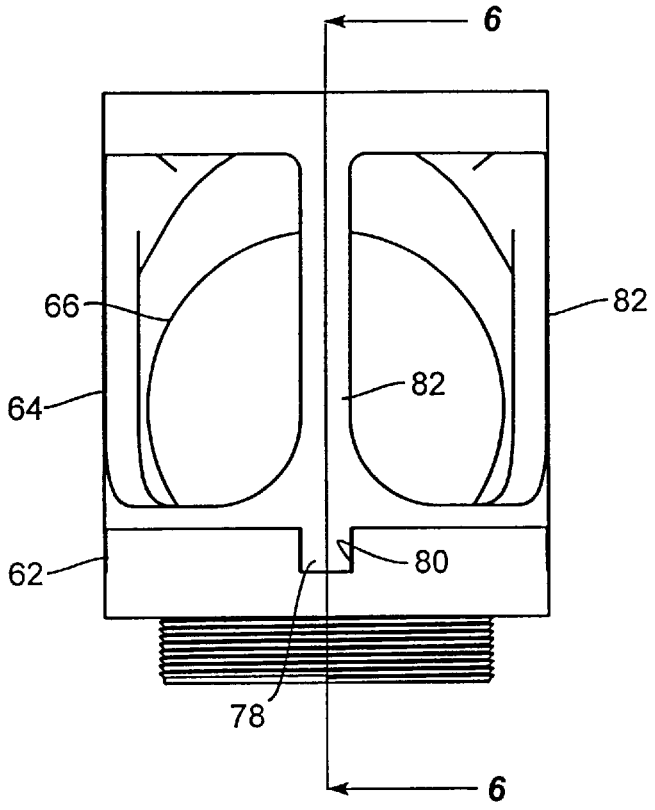
FIG. 5 is a side view of a ball valve.
Figure 6:
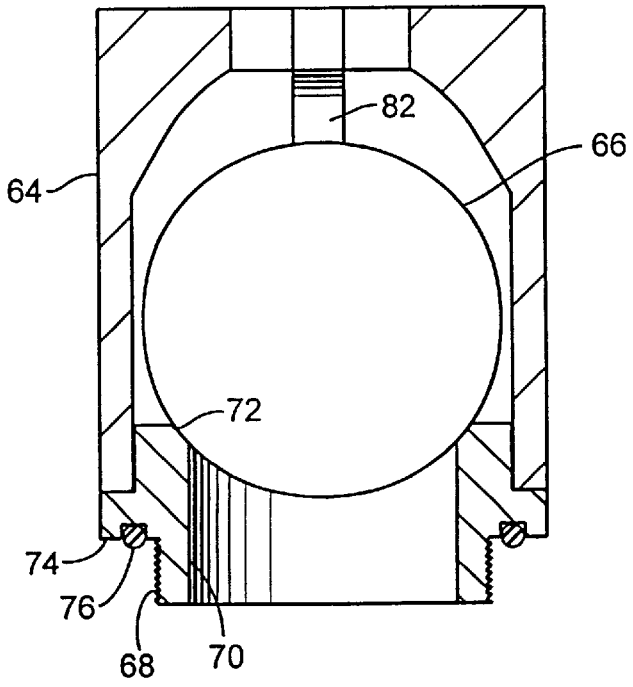
FIG. 6 is a cross-sectional view of the ball valve of FIG. 5 taken along line 6—6.

Check valves are associated with each of the inlets 26 and 28 and outlets 30 and 32 to and from the pump chambers 16 and 18. These check valves are identical ball valve designs and each includes a valve seat 62, a ball cage 64 and a valve element 66 in the form of a ball. The valve seat 62 includes a threaded section 68, a passageway 70 therethrough, a ball seat 72 for the ball 66 at one end of the passageway 70 and a radially extending annular shoulder 74 adjacent to the threaded section 68. An O-ring groove accommodates an O-ring 76 in the radially extending annular shoulder 74. As can best be seen in FIG. 5, the ball cage 64 is angularly interlocking with the valve seat 62 by means of two fingers 78 engaging two slots 80.

The ball cage 64 includes four elements 82 conveniently equiangularly spaced about the cage 64. The elements 82 extend inwardly to retain the ball 66 in upward motion. Between such elements 82, the top is substantially cut away to close to the peripheral cylindrical surface for adequate flow.

The assembled check valves are positioned in the flow connectors 40–46. A valve cavity extending along the passageway of each flow connectors is open concentrically within the flange 50. Each flow connector 40–46 also includes a threaded valve seat attachment cavity 84. As can be seen from the cross-sectional view of FIG. 1, only the check valves positioned in the inlet portion of the pump include the threaded section threadably fitting into the threaded valve seat attachment cavity 84. The flow connectors 40 and 42 associated with the outlet portion of the pump include the threaded valve seat attachment cavities 84 simply to make the flow connectors 40–46 identical. Similarly, the pump chambers 16 and 18 include threaded valve seat attachment cavities 86 in the outlets. The outlet check valves are arranged with the threaded section 68 threadably fitting with the threaded valve seat attachment cavities 86. The cavities 86 may also be associated with the inlets 26 and 28. They have no use other than to allow the inversion of each of the pump chambers 16 and 18.

Both the flow connectors 40–46 and the pump chambers 16 and 18 include radially outward sealing surfaces 88. These surfaces 88 mate with the radially extending annular shoulders 74 of the check valves to interact with the compressible seals 76 as the threaded section is positioned or the upper end of the ball cage 64 to retain the ball cage in place. The seats 72 are able to be easily put in position to compress the compressible seal 76 by using the cage 64. Because of the fingers 78 and grooves 80, the cages 64 may act as drivers to threadably seat the valve seat 62. The check valves are sized within the valve cavities such that the cross-sectional area of the flow path through the entire valve assembly with the check valve displaced from the seat is at least as great as the area of the exhaust port 58. This is also true for the passageways through the flow connectors 40–46 and the T-sections 52 and 56.

Prior designs have had the lower T-section include integral feet to support the pump in an upright position. A separate stand assembly is used to achieve a uniformity among the flow connectors 40–46. A pump stand, generally designated 90 includes four legs 92 which each have a mounting plate 94 at one end. The mounting plate includes a pattern of mounting holes such that it may be included in the assembly of the flow connectors 44 and 46 with the pump chambers 16 and 18. A rectangular base 96 made from square tubing extends to join the other ends of each of the legs 92. Plates 98 are arranged at the corners of the base 96 to accommodate casters, permanent mounting or the like.

Thus, a pump configuration and assembly has been disclosed which is of particular value in large size air driven diaphragm pumps. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A double diaphragm pump comprising air chambers;

pump chambers, each including an inlet and an outlet;

diaphragms, the air chambers and the pump chambers mating together, respectively, to form pump cavities, the diaphragms extending across the pump cavities, respectively, between the air chambers and the pump chambers;

flow connectors coupled with the pump chambers at the inlets and the outlets, respectively, the flow connectors each including a valve cavity; check valves in the valve cavities, respectively, each check valve including a valve seat and a valve element, each of the flow connectors further including a threaded valve seat attachment cavity adjacent the valve cavity sized to threadably receive one of the valve seats, the outlets of the pump chambers each including a threaded valve seat attachment cavity sized to threadably receive one of the valve seats.

2. The double diaphragm pump of claim 1, the valve seats each including a threaded section and a radially extending annular shoulder adjacent the threaded section, the threaded sections threadably fitting within the threaded valve seat attachment cavities.

3. The double diaphragm pump of claim 2, the flow connectors adjacent the threaded valve seat attachment cavities and the pump chambers adjacent the threaded valve seat attachment cavities including radially outward sealing surfaces.

4. The double diaphragm pump of claim 3 further comprising compressible seals positionable between the radially extending annular shoulders and the radially outward sealing surfaces.

5. The double diaphragm pump of claim 1, the check valves further including ball cages extending to and angularly interlocking with the valve seats.

6. The double diaphragm pump of claim 1, the flow connectors further including outlet ports each having a first cross-sectional area, the flow path through the pump cavities, the check valves with the valve elements fully displaced from the valve seats, respectively, and the flow connectors having cross-sectional flow areas at least as large as the first cross-sectional area.

7. The double diaphragm pump of claim 1, the flow connectors and the pump chambers each further including mating annular bolting flanges with an equiangularly spaced bolting pattern.

8. The double diaphragm pump of claim 7, the flow connectors being elbows.

9. The double diaphragm pump of claim 8 further comprising an inlet T-section;

an outlet T-section, the elbows and the T-sections having mating annular T-section bolting flanges with an equiangularly spaced T-section bolting pattern.

10. The double diaphragm pump of claim 7 further comprising a pump stand including four legs, each leg having a mounting plate with a plurality of mounting holes matching the equiangular spacing of the bolting pattern.

11. The double diaphragm pump of claim 10, the pump stand further including a base displaced from the flanges and fixed to one end of each of the legs.

12. A double diaphragm pump comprising air chambers;

pump chambers, each including an inlet and an outlet;

diaphragms, the air chambers and the pump chambers mating together, respectively, to form pump cavities, the diaphragms extending across the pump cavities, respectively, between the air chambers and the pump chambers;

inlet flow connectors coupled with the pump chambers at the inlets, respectively, the inlet flow connectors each including a valve cavity;

outlet flow connectors coupled with the pump chambers at the outlets, respectively, the outlet flow connectors each including a valve cavity;

valves in the valve cavities, respectively, each valve including a valve seat, each of the inlet flow connectors further including a threaded valve seat attachment cavity adjacent the valve cavity threadably receiving one of the valve seats, the outlets of the pump chambers each including a threaded valve seat attachment cavity threadably receiving one of the valve seats, the valve seats each including a threaded section and a radially extending annular shoulder adjacent the threaded section, the threaded sections threadably fitting within the threaded valve seat attachment cavities, the outlet flow connectors adjacent the threaded valve seat attachment cavities and the pump chambers adjacent the threaded valve seat attachment cavities including radially outward sealing surfaces;

compressible seals positioned between the radially extending annular shoulders and the radially outward sealing surfaces.

13. The double diaphragm pump of claim 12, the valves further including balls and ball cages, the ball cages extending to and angularly interlocking with the valve seats.

14. The double diaphragm pump of claim 12, the inlet and outlet flow connectors and the pump chambers each further including mating annular bolting flanges with an equiangularly spaced bolting pattern.

15. A double diaphragm pump comprising air chambers;

pump chambers, each including an inlet and an outlet;

diaphragms, the air chambers and the pump chambers mating together, respectively, to form pump cavities, the diaphragms extending across the pump cavities, respectively, between the air chambers and the pump chambers;

inlet flow connectors coupled with the pump chambers at the inlets, respectively, the inlet flow connectors each including a valve cavity;

outlet flow connectors coupled with the pump chambers at the outlets, respectively, the outlet flow connectors each including a valve cavity;

valves in the valve cavities, respectively, each valve including a valve seat, a ball and a ball cage, each of the inlet flow connectors further including a threaded valve seat attachment cavity adjacent the valve cavity threadably receiving one of the valve seats, the outlets of the pump chambers each including a threaded valve seat attachment cavity threadably receiving one of the valve seats, the valve seats each including a threaded section, the threaded sections threadably fitting within the threaded valve seat attachment cavities, the ball cages extending to and angularly interlocking with the valve seats.

16. The double diaphragm pump of claim 15, the flow connectors further including outlet ports each having a first cross-sectional area, the flow path through the pump cavities, the ball valves with the balls fully displaced from the valve seats, respectively, and the flow connectors having cross-sectional flow areas at least as large as the first cross-sectional area.

17. A double diaphragm pump comprising air chambers;

pump chambers, each including an inlet and an outlet;

diaphragms, the air chambers and the pump chambers mating together, respectively, to form pump cavities, the diaphragms extending across the pump cavities, respectively, between the air chambers and the pump chambers;

flow connectors coupled with the pump chambers at the inlets and outlets, respectively, the flow connectors each including a valve cavity, the flow connectors and the pump chambers each further including mating annular bolting flanges with an equiangularly spaced bolting pattern;

valves in the valve cavities, respectively;

a pump stand including four legs, each leg having a mounting plate with a plurality of mounting holes matching the equiangular spacing of the bolting pattern.

18. The double diaphragm pump of claim 17, the pump stand further including a base displaced from the flanges and fixed to one end of each of the legs.

19. A double diaphragm pump comprising air chambers;

pump chambers, each including an inlet and an outlet;

diaphragms, the air chambers and the pump chambers mating together, respectively, to form pump cavities, the diaphragms extending across the pump cavities, respectively, between the air chambers and the pump chambers;

elbows coupled with the pump chambers at the inlets and the outlets, respectively, the elbows each including a valve cavity and an outlet port having a first cross-sectional area;

ball valves in the valve cavities, respectively, each ball valve including a valve seat, a ball and a ball cage extending to and angularly interlocking with the valve seat, each of the elbows further including a threaded valve seat attachment cavity adjacent the valve cavity sized to threadably receive one of the valve seats, the outlets of the pump chambers each including a threaded valve seat attachment cavity sized to threadably receive one of the valve seats, the valve seats each including a threaded section and a radially extending annular shoulder adjacent the threaded section, the threaded sections threadably fitting within the threaded valve seat attachment cavities, the elbows adjacent the threaded valve seat attachment cavities and the pump chambers adjacent the threaded valve seat attachment cavities including radially outward sealing surfaces, the flow path through the pump cavities, the ball valves with the balls fully displaced from the valve seats, respectively, and the elbows having cross-sectional flow areas at least as large as the first cross-sectional area;

compressible seals positionable between the radially extending annular shoulders and the radially outward sealing surfaces.

20. The double diaphragm pump of claim 19, the elbows and the pump chambers each further including mating annular bolting flanges with an equiangularly spaced bolting pattern.

21. The double diaphragm pump of claim 20 further comprising an inlet T-section;

an outlet T-section, the elbows and the T-sections having mating annular T-section bolting flanges with an equiangularly spaced T-section bolting pattern.

22. The double diaphragm pump of claim 20 further comprising a pump stand including four legs, each leg having a mounting plate with a plurality of mounting holes matching the equiangular spacing of the bolting pattern.

23. The double diaphragm pump of claim 22, the pump stand further including a base displaced from the flanges and fixed to one end of each of the legs.

* * * * *